US005707778A

United States Patent [19]

Minami et al.

[11] Patent Number: 5,707,778

[45] Date of Patent: *Jan. 13, 1998

[54] OPTICAL RECORDING MEDIUM

[75] Inventors: Toshiaki Minami; Tomoaki Nagai; Kaoru Hamada; Akio Sekine; Toshimi Satake; Toshiyuki Takano; Hideki Hayasaka, all of Tokyo, Japan

[73] Assignee: Nippon Paper Industries Co., Ltd., Tokyo, Japan

[ * ] Notice: The term of this patent shall not extend beyond the expiration date of Pat. No. 5,494,882.

[21] Appl. No.: 613,720

[22] Filed: Mar. 12, 1996

Related U.S. Application Data

[63] Continuation of Ser. No. 318,333, Oct. 5, 1994, abandoned.

[30] Foreign Application Priority Data

Oct. 5, 1993 [JP] Japan ..... 5-249204

[51] Int. Cl.[6] ..... B41M 5/26

[52] U.S. Cl. ..... 430/270.1; 430/338; 430/945; 430/964; 430/944; 503/201; 503/218; 503/221; 503/226; 503/216; 503/225

[58] Field of Search ..... 503/216, 218, 503/221, 226, 225, 201; 430/270.1, 338, 944, 964, 945; 346/135.1

[56] References Cited

U.S. PATENT DOCUMENTS

| | | | |
|---|---|---|---|
| 4,520,370 | 5/1985 | Fujii et al. | 346/108 |
| 5,178,990 | 1/1993 | Satake et al. | 430/338 |
| 5,273,800 | 12/1993 | Satake et al. | 430/270.1 |
| 5,434,119 | 7/1995 | Satake et al. | 503/216 |
| 5,494,882 | 2/1996 | Satake et al. | 503/216 |

FOREIGN PATENT DOCUMENTS

| | | | |
|---|---|---|---|
| 3382425A | 8/1990 | European Pat. Off. . | |
| 0521706 | 1/1993 | European Pat. Off. | B41M 5/30 |
| 521706A1 | 1/1993 | European Pat. Off. . | |
| 0611754A | 8/1994 | European Pat. Off. . | |
| 60-145884 | 8/1985 | Japan | B41M 5/18 |
| 3-239598 | 10/1991 | Japan . | |
| 5-4449 | 1/1993 | Japan | B41M 5/18 |
| 6-227142 | 8/1994 | Japan | B41M 5/18 |

OTHER PUBLICATIONS

Chemical Abstracts, vol. 104, No. 6, 10 Feb. 1986.
Abstract of U.S. Application Ser. No. 08/233,759.
Abstract of U.S. Application Ser. No. 08/197,948.
English Language Abstract of Japanese L-O-P 57-11090(A).
English Language Abstract of Japanese L-O-P 58-94494(A).
English Language Abstract of Japanese L-O-P 58-209594(A).
English Language Abstract of Japanese L-O-P 60-145884(A).
English Language Abstract of Japanese L-O-P 2-206583(A).
English Language Abstract of Japanese L-O-P 2-217287(A).
English Language Abstract of Japanese L-O-P 3-73814(A).
English Language Abstract of Japanese L-O-P 3-239598(A).
English Language Abstract of Japanese L-O-P 4-353490(A).
English Language Abstract of Japanese L-O-P 5-4449(A).
English Language Abstract of Japanese L-O-P 5-185739(A).
English Language Abstract of Japanese L-O-P 6-87269(A).
English Language Abstract of Japanese L-O-P 6-92019(A).
English Language Abstract of Japanese L-O-P 6-227142(A).
English Language Abstract of Japanese L-O-P 6-247052(A).
English Language Abstract of Japanese L-O-P 6-255258(A).
English Language Abstract of Japanese L-O-P 6-255259(A).
English Language Abstract of Japanese L-O-P 6-270546(A).
English Language Abstract of Japanese L-O-P 54004142(A).
Chemical Industries, vol. 43, May, 1986 pp. 379-389.

*Primary Examiner*—Martin Angebranndt
*Attorney, Agent, or Firm*—Sherman and Shalloway

[57] ABSTRACT

An optical recording medium including a substrate having thereon a recording layer containing a dye precursor, a color developer reactable with the dye precursor to develop a color, and a light absorbent for converting light to heat, characterized in that the color developer is at least one compound of Formula (1):

$$(R—NH\ (C{=}S)\ NH)n—Z \quad (1)$$

(wherein R denotes a substituted or unsubstituted alkyl, cycloalkyl, aryl, aralkyl, or alkenyl. n is an integer of 2 or more, and Z denotes a group having a valence of 2 or more.). The optical recording medium is superior in heat resistance and plasticizer resistance of the recorded image, heat resistance of background, water resistance, and moisture resistance.).

13 Claims, No Drawings

OPTICAL RECORDING MEDIUM

This application is a continuation, of application Ser. No. 08/318,333, filed Oct. 5, 1994, now abandoned.

FIELD OF THE INVENTION

This invention relates to an optical recording medium which forms a color image by irradiation with light, more specifically to an optical recording medium which is superior in resistance of the recorded image to oil and plasticizer, storage stability to heat, small in fogging of background, and heat stability of background.

DESCRIPTION OF THE PRIOR ART

Thermal recording is a direct recording method which does not require development or fixing, and is widely used in facsimile and printers. However, since, in this method, a thermal head or thermal IC pen as a heating element is contacted directly with the thermal recording paper, a color developing melt or the like tends to adhere to the heating element, resulting in a degraded recording function.

Further, a thermal recording method using a thermal head is limited in increasing the density of the heating element, the resolution is typically about 10/mm, and recording of a higher density is difficult.

Then, a noncontacting recording method by light is proposed as a method for further improving the resolution without degrading the recording function.

Japanese Patent Laid-open Publication (OPI) 58-148776 discloses that thermal recording is possible using a carbon dioxide laser as a recording light source, by converging and scanning the laser light on the thermal recording paper. This recording method requires a high laser output power in spite of the fact that the thermal recording paper absorbs the oscillation wavelength of the carbon dioxide laser. The recording apparatus is impossible to be designed compact partly because of the use of a gas laser, and has a problem in fabrication cost.

Further, since conventional thermal recording medium is hard to absorb light in the visible and near-infrared regions, when a laser having an oscillation wavelength in the visible or near-infrared region, a required heat energy cannot be obtained unless the laser output power is increased to a great extent.

In addition, an optical recording medium comprising a combination of a conventional thermal recording material and a light absorbent material is proposed in Japanese OPIs 54-4142, 57-11090, 58-94494, 58-209594, and so on.

Japanese OPI 54-4142 discloses that in a thermal recording medium having a substrate coated thereon with a thermal recording layer mainly comprising a leuco dye, using a metal compound having a lattice defect, the metal compound absorbs light of the visible or infrared region to convert it to heat, thereby enabling thermal recording. Japanese OPI 57-11090 describes an optical recording medium having a recording layer comprising a colorless or pale colored color forming substance, a phenolic substance, and an organic polymer binder, containing therein a benzenedithiol nickel complex as a light absorber, which allows recording with laser light. Japanese OPI 58-94494 discloses recording medium having a substrate coated thereon with one or more thermal color forming materials, and one or more near-infrared absorbent material comprising a compound having a peak absorption wavelength in the near-infrared region of 0.7 to 3 μm. Japanese OPI 58-209594 discloses an optical recording medium characterized in that at least one set of a near-infrared absorbent material having an absorption wavelength in the near-infrared region of 0.8 to 2 μm and at least one thermal color forming material is coated on a substrate.

However, since these optical recording media use conventional thermal recording materials, especially conventional color developers, they have a disadvantage that oil or a plasticizer tends to adhere to their surface, causing disappearance of the recorded image or fogging of the background by heat.

With heat resistance of an optical recording medium applying a prior art thermal recording medium which uses a phenolic color developer as a color forming material, it has been impossible to heat laminate the recording surface or the entire recording medium with a film or the like.

When the above high-power laser is not used as a recording light source, to improve the optical recording sensitivity of the optical recording medium comprising a dye precursor, a color developer, a light absorbent, and the like, use of a color developer having a high thermal recording sensitivity, addition of a thermal recording sensitizer, or an increase in content of the light absorber is considered. However, use of a color developer of good thermal recording sensitivity or addition of a thermal recording sensitizer tends to deteriorate the heat resistance of the optical recording medium. Further, an increase in content of the light absorber, for a visibility recording medium, results in a considerable decrease in contrast between the recorded image and the background, and has a problem in cost.

Therefore, a primary object of the present invention is to provide an optical recording medium comprising a thermal recording material (a dye precursor and a color developer) and a light absorber material, which solves the above prior art problems, is superior in oil resistance, plasticizer resistance, and heat resistance, and very good in stability of background, especially in heat resistance of background.

SUMMARY OF THE INVENTION

In accordance with the present invention, which attains the above objective, there is provided an optical recording medium comprising a substrate having thereon a recording layer containing a dye precursor, a color developer reactable with the dye precursor to develop a color, and a light absorber for converting light to heat, characterized in that the color developer is at least one compound of Formula (1):

$$(R—NH\ (C{=}S)\ NH)_n—Z \qquad (1)$$

(wherein R denotes a substituted or unsubstituted alkyl, cycloalkyl, aryl, aralkyl, or alkenyl; n is an integer of 2 or more; and Z denotes a group having a valence of 2 or more. At least one of R and Z has at least one aromatic ring adjacent to the —NH(C=S)NH— group in the Formula.).

The color developer of Formula (1) used in the optical recording medium of the present invention is considered to provide color developing ability by a structural change from the thione type structure shown by Formula (1) to a thiol type structure. At least one aromatic ring adjacent to the —NH(C=S)NH— group of Formula (1) is sufficient to promote a change to the thiol type structure, which is considered to show a color developing ability, and stabilize.

Therefore, under the condition that at least one of R and Z of Formula (1) has at least one aromatic ring adjacent to the —NH(C=S)NH— in the Formula, R denotes a substituted or unsubstituted alkyl, cycloalkyl, aryl, aralkyl, or alkenyl; n is an integer of 2 or more, and Z denotes a group having a valence of 2 or more.

In R of Formula (1), the alkyl is, for example, methyl, ethyl, propyl, butyl, heptyl, dodecyl, or stearyl; the cycloalkyl is, for example, cyclopentyl or cyclohexyl; the aryl is, for example, phenyl or naphthyl; the aralkyl is, for example, benzyl; and the alkenyl is, for example, vinyl, allyl, or 3-butenyl. Further, each group denoted by R may be one which is further substituted with a lower alkyl having 1 to 6 carbon atoms or halogen atom.

In Formula (1), typical groups that can be denoted by Z are those shown in (a1) to (a28) or (b1) to (b46) below, and may be those having a valence of 2 or more, but are not specifically limited.

$-CH_2-$ (a1)

$-(CH_2)_2-$ (a2)

$-(CH_2)_3-$ (a3)

$-(CH_2)_4-$ (a4)

$-(CH_2)_5-$ (a5)

$-(CH_2)_6-$ (a6)

$-(CH_2)_7-$ (a7)

$-(CH_2)_8-$ (a8)

$-(CH_2)_9-$ (a9)

$-(CH_2)_{10}-$ (a10)

$-(CH_2)_{11}-$ (a11)

$-(CH_2)_{12}-$ (a12)

$-CH(CH_3)-CH_2-$ (a13)

$-C(CH_3)_2-CH_2-$ (a14)

$-CH(CH_3)-(CH_2)_2-$ (a15)

$-CH(C_2H_5)-(CH_2)_2-$ (a16)

$-CH_2-C(CH_3)_2-CH_2-$ (a17)

$-CH_2-CH(CH_3)-(CH_2)_3-$ (a18)

$-CH_2-CH(CH_3)-(CH_2)_4-$ (a19)

$-(CH_2)_2-N(CH_3)-(CH_2)_2-$ (a20)

$-(CH_2)_3-NH-(CH_2)_3-$ (a21)

$-(CH_2)_3-N(CH_3)-(CH_2)_3-$ (a22)

$-(CH_2)_3-N(COOCH_3)-(CH_2)_3-$ (a23)

$-(CH_2)_3-N(C_6H_5)-(CH_2)_3-$ (a24)

$-(CH_2)_4-CH(COOCH_3)-$ (a25)

$-(CH_2)_2-O-(CH_2)_4-O-(CH_2)_2-$ (a26)

$-(CH_2)_3-O-(CH_2)_3-$ (a27)

$-(CH_2)_3-O-(CH_2)_2-O-(CH_2)_3-$ (a28)

(b1)

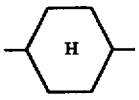

-continued (b2)

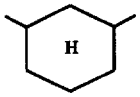

(b3)

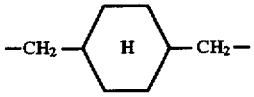

(b4)

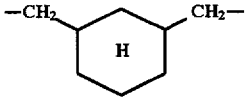

(b5)

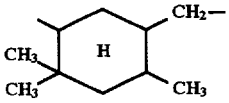

(b6)

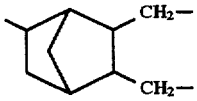

(b7)

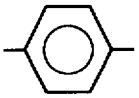

(b8)

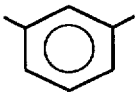

(b9)

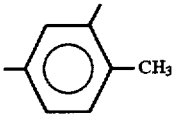

(b10)

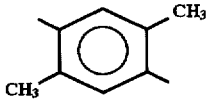

(b11)

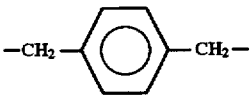

(b12)

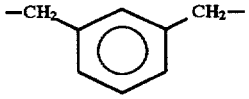

(b13)

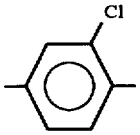

(b14)

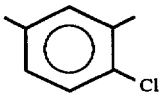

(b15)

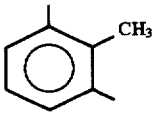

-continued
(b16)
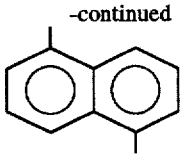
(b17)
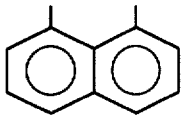
(b18)
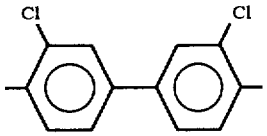
(b19)
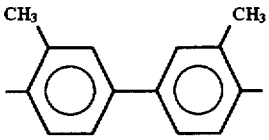
(b20)
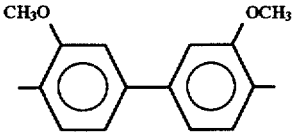
(b21)
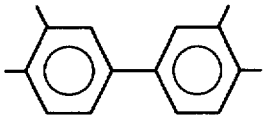
(b22)
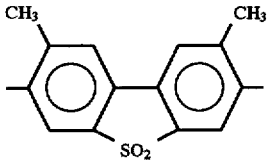
(b23)
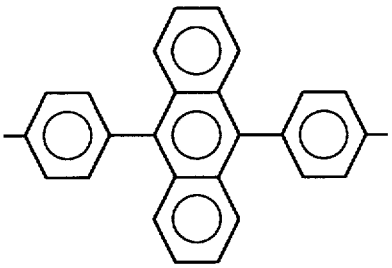
(b24)
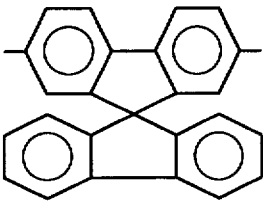
(b25)
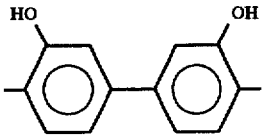
-continued
(b26)
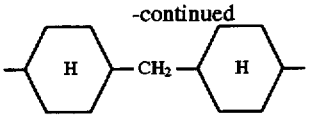
(b27)
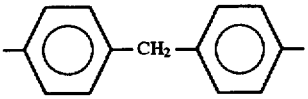
(b28)
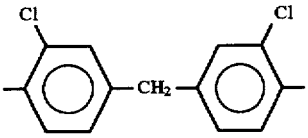
(b29)
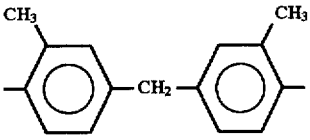
(b30)
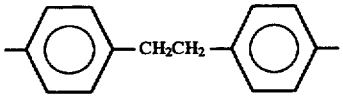
(b31)
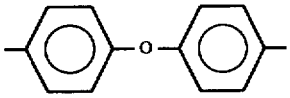
(b32)
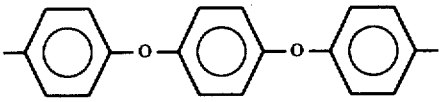
(b33)
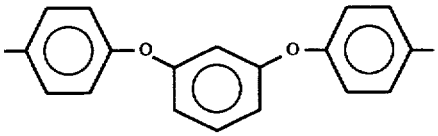
(b34)
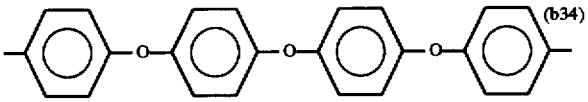
(b35)
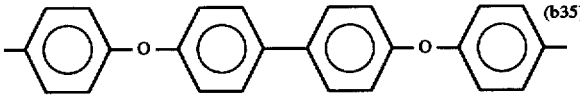
(b36)
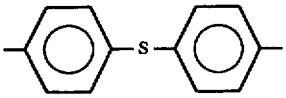
(b37)
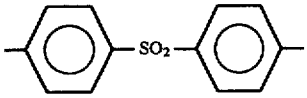
(b38)
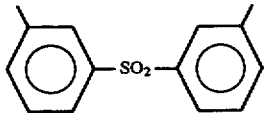
(b39)
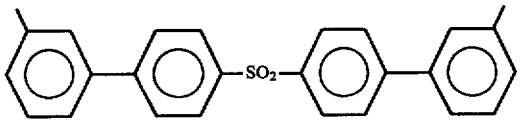

-continued
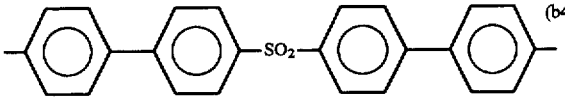
(b40)
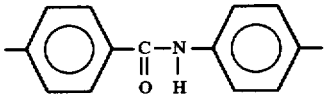
(b41)
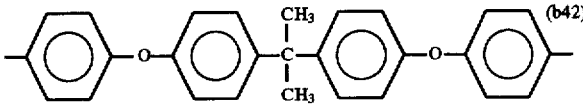
(b42)
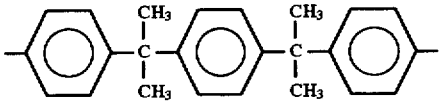
(b43)
-continued
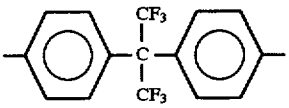
(b44)
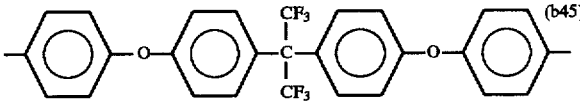
(b45)
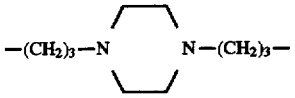
(b46)
Practical examples of the compound of Formula (1) used in the present invention are shown below, but are not limited thereto:
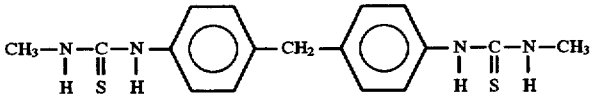
(A1)
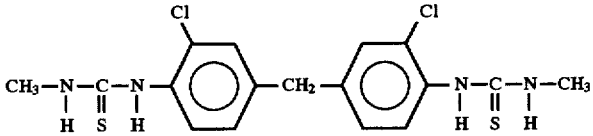
(A2)
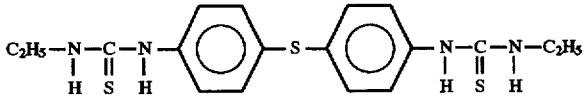
(A3)
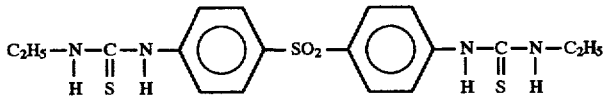
(A4)
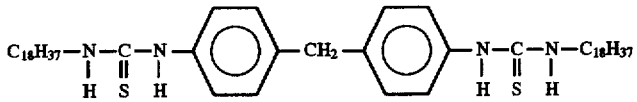
(A5)
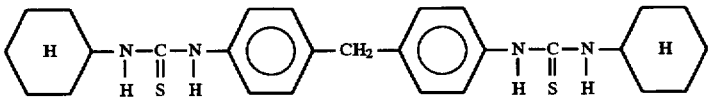
(A6)
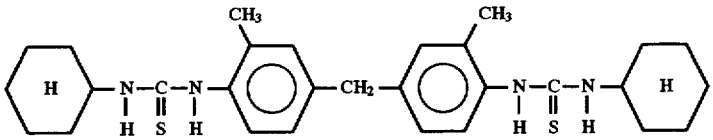
(A7)
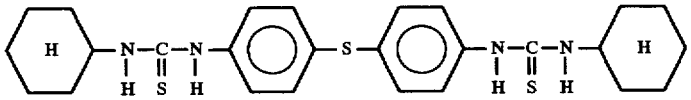
(A8)
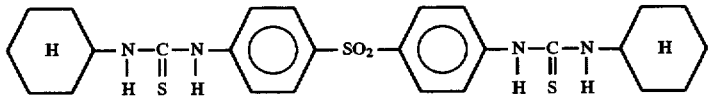
(A9)

-continued
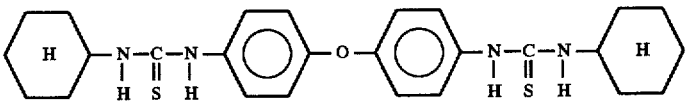
(A10)
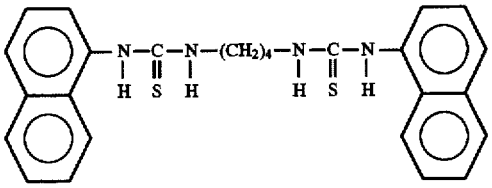
(A11)
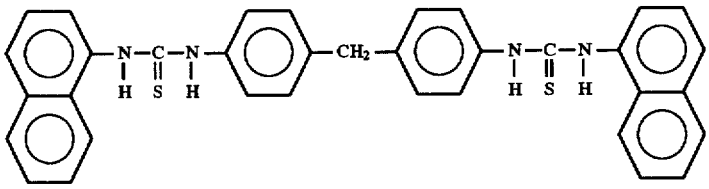
(A12)
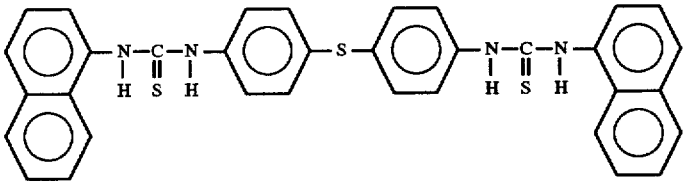
(A13)
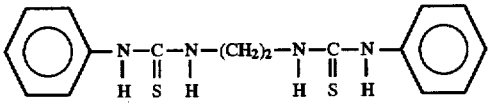
(A14)
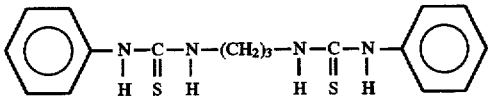
(A15)
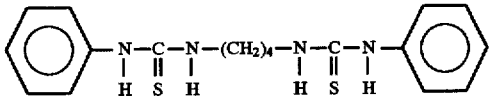
(A16)
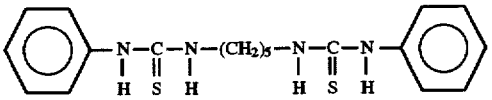
(A17)
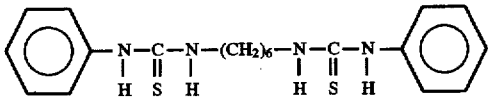
(A18)
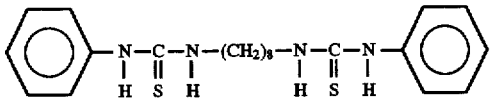
(A19)
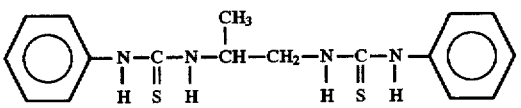
(A20)
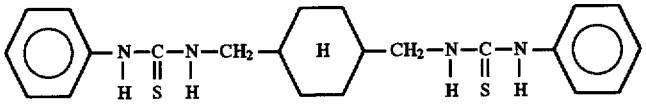
(A21)

-continued
(A22)
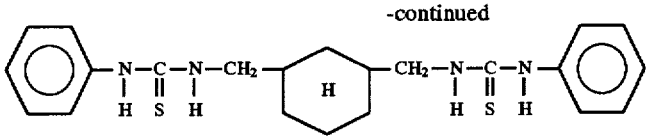
(A23)
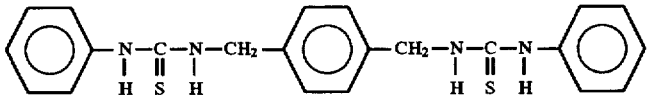
(A24)
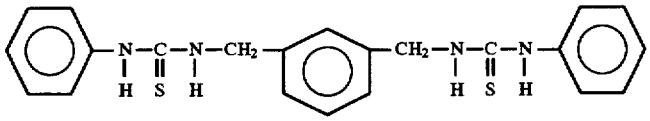
(A25)
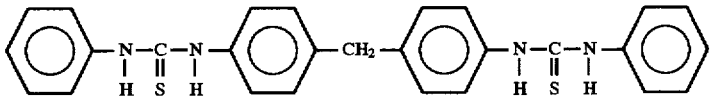
(A26)
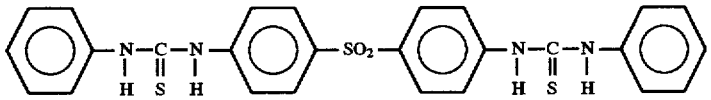
(A27)
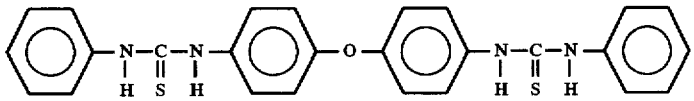
(A28)
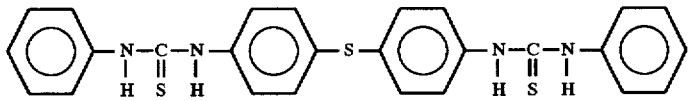
(A29)
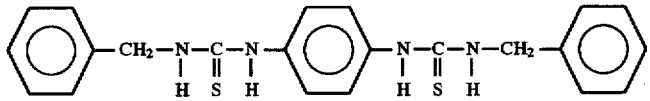
(A30)
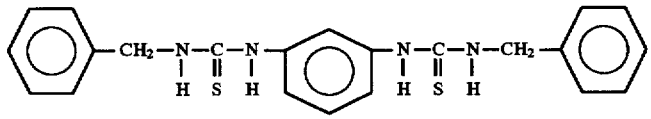
(A31)
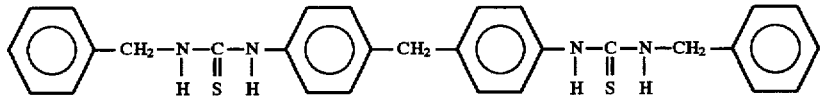
(A32)
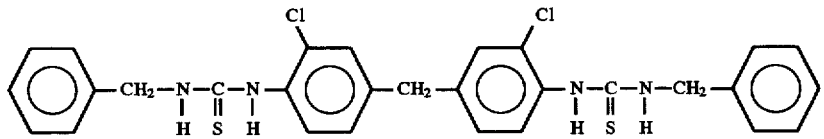
(A33)
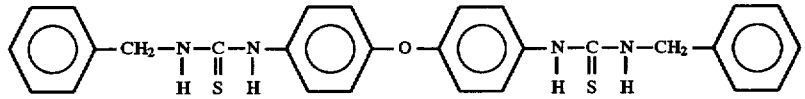
(A34)
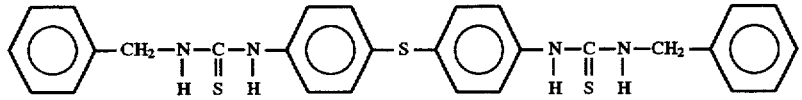
(A35)
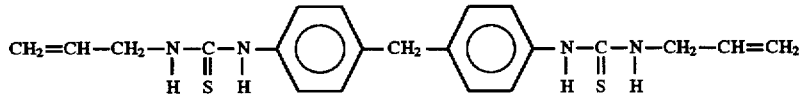

-continued

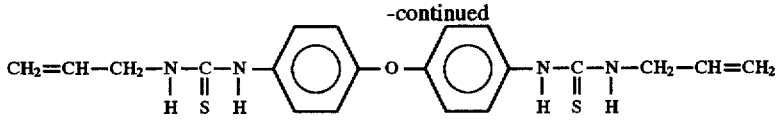

(A36)

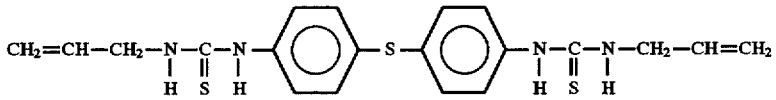

(A37)

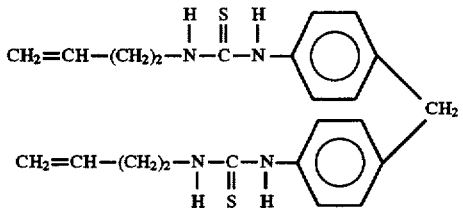

(A38)

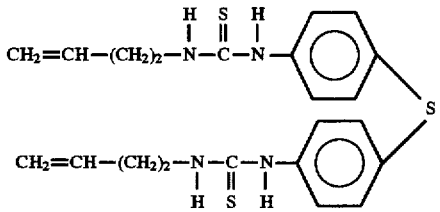

(A39)

Further, in view of heat resistance and availability of raw materials, the above object is attained to good advantage with an optical recording medium comprising a substrate having thereon a recording layer containing a dye precursor, a color developer reactable for developing a color with the dye precursor, and a light absorber for converting light to heat, wherein the color developer is at least, one compound of Formula (2) or (3):

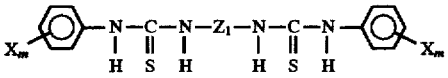

(2)

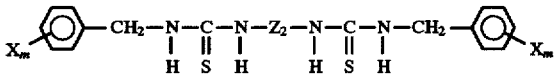

(3)

(wherein X denotes a lower alkyl having 1 to 6 carbon atoms, alkoxy having 1 to 6 carbon atoms, cyclohexyl, nitro, cyano, halogen or hydrogen; $Z_1$ denotes a divalent group; $Z_2$ denotes a divalent group having at least one aromatic ring adjacent to the —NH(C=S)NH— group in the Formula; and m is an integer from 1 to 3.).

In Formula (2), $Z_1$ may be a divalent group selected from those shown in (a1) to (a28) or (b1) to (b46) shown above, but is not specifically limited. Practical examples of compounds of Formula (2) used in the present invention are those of (A14) to (A28) shown above, but are not specifically limited thereto.

In Formula (3), $Z_2$ may be a divalent group having at least one aromatic ring adjacent to the —NH(C=S)NH— group in the Formula, such as those of (b7) to (b25) or (b27) to (b45) shown above, but are not specifically limited. Practical examples of compounds of Formula (3) used in the optical recording medium of the present invention are those of (A29) to (A34) shown above, but are not limited thereto.

In particular, in view of a very high heat resistance and also the optical recording sensitivity, the above object is attained with an optical recording medium comprising a substrate having thereon a recording layer containing a dye precursor, a color developer reactable for developing a color with the dye precursor, and a light absorber for converting light to heat, wherein the color developer is at least one compound of Formula (4) shown below:

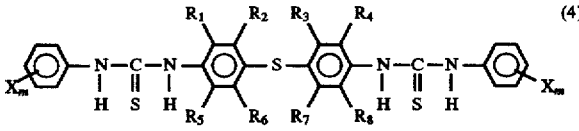

(4)

(wherein X, $R_1$, $R_2$, $R_3$, $R_4$, $R_5$, $R_6$, $R_7$ and $R_8$ are lower alkyl having 1 to 6 carbon atoms, alkoxy having 1 to 6 carbon atoms, cyclohexyl, nitro, cyano, halogen or hydrogen; and m is an integer from 1 to 3.).

Practical examples of compounds of Formula (4) are the compound of (A28) or the following compounds.

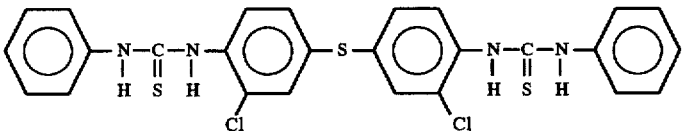

(B1)

-continued

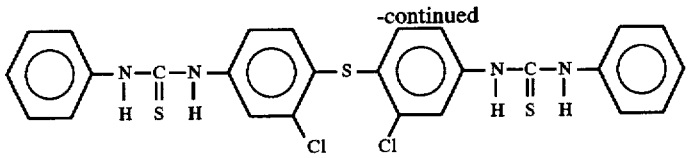

(B2)

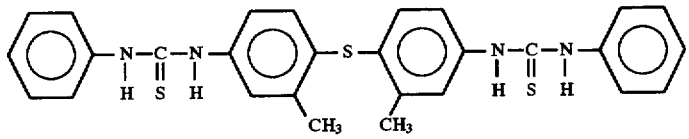

(B3)

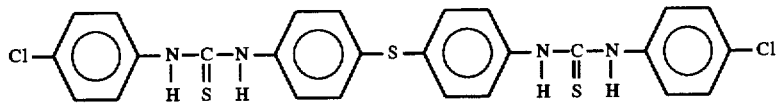

(B4)

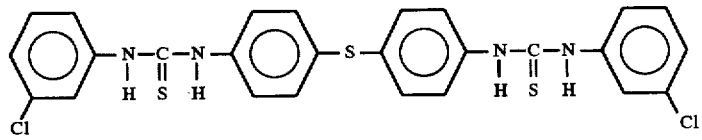

(B5)

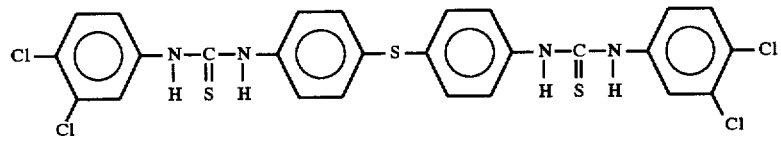

(B6)

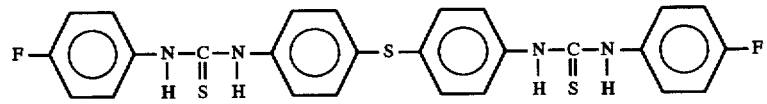

(B7)

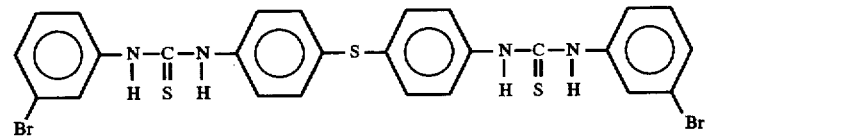

(B8)

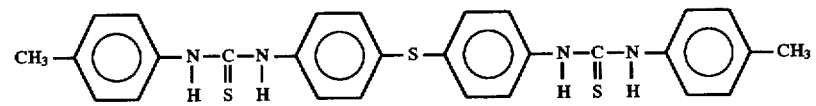

(B9)

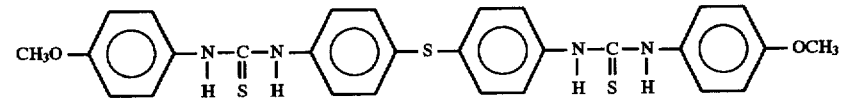

(B10)

The extremely high heat resistance of the optical recording medium using the color developer of Formula (4) enables heat lamination of the optical recording surface of the optical recording medium or the entire optical recording medium.

The above object is also attained to good advantage with an optical recording medium comprising a substrate having thereon a recording layer containing a dye precursor, a color developer reactable for developing a color with the dye precursor, and a light absorber for converting light to heat, wherein the color developer is at least one compound of Formula (5) shown below. In this case, a particularly high heat resistance is obtained.

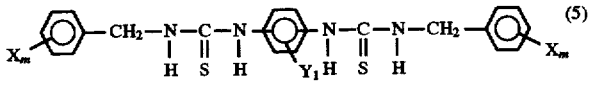

(5)

(wherein X and Y are lower alkyl having 1 to 6 carbon atoms, alkoxy having 1 to 6 carbon atoms, cyclohexyl, nitro, cyano, halogen or hydrogen; m is an integer from 1 to 3; and 1 is an integer from 1 to 4.).

Practical examples of compounds of Formula (5) are those of (A29) or (A30) or the following compounds.

(C1)

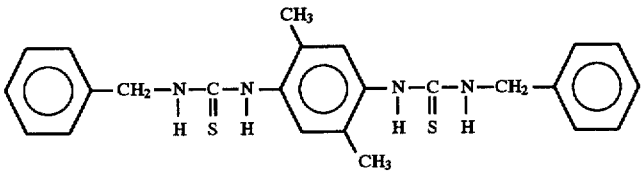

(C2)

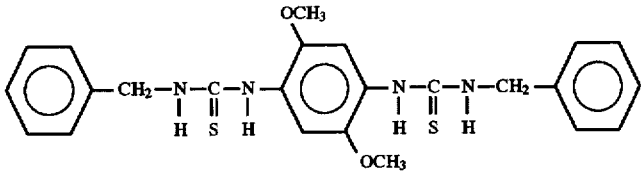

(C3)

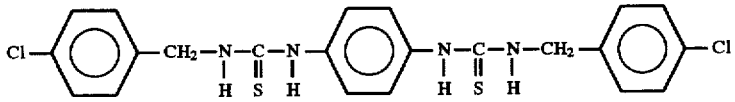

(C4)

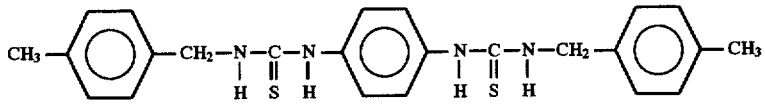

(C5)

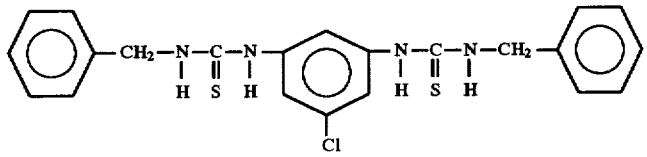

(C6)

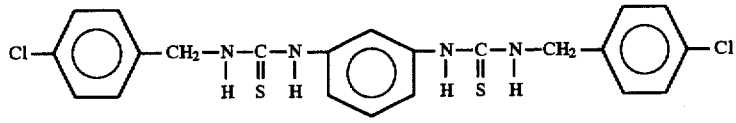

(C7)

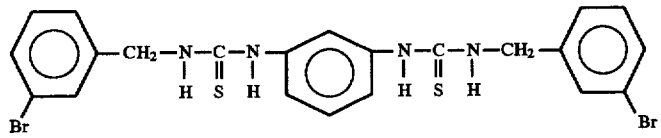

(C8)

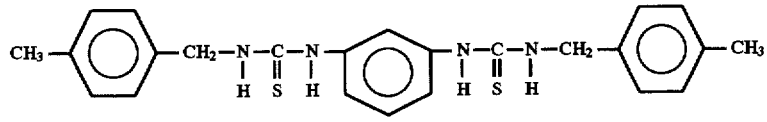

(C9)

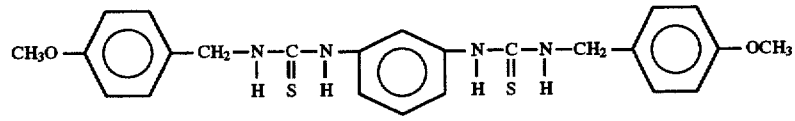

(C10)

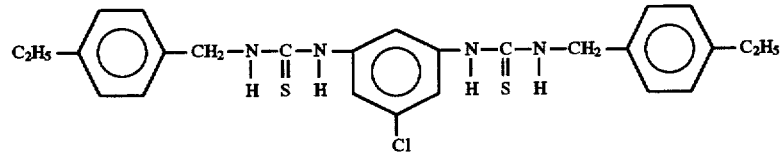

The extremely high heat resistance of the optical recording medium using the color developer of Formula (5) enables heat lamination of the optical recording surface of the optical recording medium or the entire optical recording medium.

The light absorber for converting light to heat used in the inventive optical recording medium may be a substance which absorbs the emission wavelength of various light sources, and varieties of dyestuffs, pigments, and near-infrared absorber can be used.

When a stroboscopic flash lamp having continuous emission wavelength is used as a recording light source, the light absorber for converting light to heat can be a heat reaction product of a thiourea derivative with a copper compound described in Japanese OPI 2-206583 or Japanese Patent Application 5-30954, graphite described in Japanese OPI 3-86580, copper sulfide, lead sulfide, molybdenum trisulfide, black titanium oxide, or the like, and carbon black can also be used. These light absorber can also be used for laser recording.

A semiconductor laser, which is superior in terms of compact design, safety, cost, and modulation, is used as a recording laser, particularly when a semiconductor laser having oscillation wavelengths from the visible regions to the near-infrared region is used, materials having absorptions adaptable to the oscillation wavelengths include polymethine type dyes (cyanine dyes), azulenium type dyes, xpyrylium type dyes, thiopyrylium type dyes, squarylium type dyes, croconium type dyes, dithiol-metal complex type dyes, mercaptophenol-metal complex type dyes, mercaptonaphthol-metal complex type dyes, phthalocyanine type dyes, naphthalocyanine type dyes, triarylmethane type dyes, immonium type dyes, diimmonium type dyes, naphthoquinone type dyes, anthraquinone type dyes, and metal complex type dyes which are disclosed in Japanese OPIs 54-4142, 58-94494, 58-209594, 2-217287, and 3-73814, and "Near Infrared Absorption Dyestuffs" (Chemical Industry (Japan), 43, May 1986).

The polymethine type dyes (cyanine dyes) include Indocyanine Green (made by Daiichi Seiyaku Co., Ltd.), NK-2014 (made by Nippon Kanko Shikiso Kenkyusho Co., Ltd.), NK-2612 (made by Nippon Kanko Shikiso Kenkyusho Co., Ltd.), 1,1,5,5-tetrakis(p-dimethylaminophenyl)-3-methoxy-1,4-pentadiene, 1,1,5,5-tetrakis(p-diethylaminophenyl)-3-methoxy-1,4-pentadiene, and the like; the squarylium dyes include NK-2772 (made by Nippon Kanko Shikiso Kenkyusho Co., Ltd.) and the like; the dithiol-metal complex type dyes include toluenedithiolnickel complex, 4-tert-butyl-1,2-benzenedithiolnickel complex, bisdithiobenzylnickel complex, PA-1005 (made by Mitsui Toatsu Senryo Co., Ltd.), PA-1006 (made by Mitsui Toatsu Senryo Co., Ltd.), bis(4-ethyldithiobenzyl) nickel complex and bis(4-n-propyldithiobenzyl)nickel complex described in Japanese Patent Application 4-80646, and the like; the immonium type dyes or the diimmonium type dyes include IRG002 (made by Nippon Kayaku Co., Ltd.), IRG022 (made by Nippon Kayaku Co., Ltd.), and the like; the naphthalocyanine type dyes include NIR-4, NIR-14 (made by Yamamoto Kasei Co., Ltd.) and the like; and the anthraquinone type dyes include IR-750 (made by Nippon Kayaku Co., Ltd.) and the like.

These optical absorbents can be used alone or as mixtures of two or more types.

The dye precursor used in the thermal recording medium of the present invention can be those which are known to the public in the area of pressure-sensitive or thermal recording, and is not specifically limited, but triphenylmethane type compounds, fluorane type compounds, fluorene type compounds, divinyl type compounds, and the like are preferable. Typical dye precursors are shown below:

<Triphenylmethane type leuco dyes>

Crystal Violet Lactone (CVL)

Malachite Green Lactone

<Fluorane type leuco dyes>

3-Diethylamino-6-methyl-7-anilinofluorane
3-Diethylamino-6-methyl-7-(o,p-dimethylanilino)fluorane
3-Diethylamino-6-methyl-7-chlorofluorane
3-Diethylamino-6-methyl-7-(m-trifluoromethylanilino) fluorane
3-Diethylamino-6-methyl 7-(o-chloroanilino)fluorane
3-Diethylamino-6-methyl-7-(p-chloroanilino)fluorane
3-Diethylamino-6-methyl-7-(o-fluoroanilino)fluorane
3-Diethylamino-6-methyl-7-n-octylanilinofluorane
3-Diethylamino-6-methyl-7-benzylanilinofluorane
3-Diethylamino-6-methyl-7-dibenzylanilinofluorane
3-Diethylamino-6-chloro-7-methylfluorane
3-Diethylamino-6-chloro-7-anilinofluorane
3-Diethylamino-6-chloro-7-p-methylanilinofluorane
3-Diethylamino-6-ethoxyethyl-7-anilinofluorane
3-Diethylamino-6-methylfluorane
3-Diethylamino-7-methylfluorane
3-Diethylamino-7-chlorofluorane
3-Diethylamino-7-(m-trifluoromethylanilino)fluorane
3-Diethylamino-7-(o-chloroanilino)fluorane
3-Diethylamino-7-(p-chloroanilino)fluorane
3-Diethylamino-benzo[a ]fluorane
3-Diethylamino-benzo[c ]fluorane
3-Dibutylamino-6-methyl-7-anilinofluorane
3-Dibutylamino-6-methyl-7-(o,p-dimethylanilino)fluorane
3-Dibutylamino-6-methyl-7-(o-chloroanilino)fluorane
3-Dibutylamino-6-methyl-7-(p-chloroanilino)fluorane
3-Dibutylamino-6-methyl-7-(o-fluoroanilino)fluorane
3-Dibutylamino-6-methyl-7-(m-trifluoromethylanilino) fluorane
3-Dibutylamino-6-methyl-chlorofluorane
3-Dibutylamino-6-ethoxyethyl-7-anilinofluorane
3-Dibutylamino-6-chloro-7-anilinofluorane
3-Dibutylamino-6-methyl-7-p-methylanilinofluorane
3-Dibutylamino-7-(o-chloroanilino)fluorane
3-n-Dipentylamino-6-methyl-7-anilinofluorane
3-n-Dipentylamino-6-methyl-7-(p-chloroanilino)fluorane
3-n-Dipentylamino-6-chloro-7-anilinofluorane
3-n-Dipentylamino-7-(p-chloroanilino)fluorane
3-(N-ethyl-p-toluidino)-6-methyl-7-anilinofluorane
3-(N-ethyl-N-isoamylamino)-6-methyl-7-anilino)fluorane
3-Pyrrolidino-6-methyl-7-anilinofluorane
3-Piperidino-6-methyl-7-anilinofluorane
3-(N-cyclohexyl-N-methylamino)-6-methyl-7-anilinofluorane
3-(N-ethyl-N-tetrahydrofurfurylamino)-6-methyl-7-anilinofluorane
3-(N-methyl-N-propylamino)-6-methyl-7-anilinofluorane
3-(N-ethyl-N-cyclohexylamino)-6-methyl-7-anilinofluorane
3-(N-ethyl-N-hexylamino)-6-methyl-7-(p-chloroanilino) fluorane
3-(N-ethyl-N-isoamylamino)-6-chloro-7-anilinofluorane
3-Cyclohexylamino-6-chlorofluorane
2-(4-Oxahexyl)-3-dimethylamino-6-methyl-7-anilinofluorane
2-(4-Oxahexyl)-3-diethylamino-6-methyl-7-anilinofluorane
2-(4-Oxahexyl)-3-dipropylamino-6-methyl-7-anilinofluorane
2-Methyl-6-p-(p-dimethylaminophenyl) aminoanilinofluorane
2-Methoxy-6-p-(p-dimethylaminophenyl) aminoanilinofluorane
2-Chloro-3-methyl-6-p-(p-phenylaminophenyl) aminoanilinofluorane
2-Chloro-6-p-(p-dimethylaminophenyl) aminoanilinofluorane
2-Nitro-6-p-(p-diethylaminophenyl)aminoanilinofluorane
2-Amino-6-p-(p-diethylaminophenyl)aminoanilinofluorane
2-Diethylamino-6-p-(p-diethylaminophenyl) aminoanilinofluorane
2-Benzyl-6-p-(p-phenylaminophenyl)aminoanilinofluorane
2-Hydroxy-6-p-(p-phenylaminophenyl) aminoanilinofluorane
3-Methyl-6-p-(p-dimethylaminophenyl) aminoanilinofluorane
3-Diethylamino-6-p-(p-diethylaminophenyl) aminoanilinofluorane
3-Diethylamino-6-p-(p-dibutylaminophenyl) aminoanilinofluorane <Fluorene type leuco dyes>

3,6,6'-Tris(dimethylamino)spiro[fluorene-9,3'-phthalide]
3,6,6'-Tris(diethylamino)spiro[fluorene-9,3'-phthalide]
<Divinyl type leuco dyes>

3,3-Bis-[2-(p-dimethylaminophenyl)-2-(p-methoxyphenyl) ethenyl]-4,5,6,7-tetrabromophthalide
3,3-Bis-[2-(p-dimethylaminophenyl)-2-(p-methoxyphenyl) ethenyl]-4,5,6,7-tetrachlorophthalide
3,3-Bis-[1,1-bis(pyrrolidinophenyl)-2-(p-methoxyphenyl) ethylen-2-yl]-4,5,6,7-tetrabromophthalide
3,3-Bis-[1-(4-methoxyphenyl)-1-(4-pyrrolidinophenyl) ethylen-2-yl]-4,5,6,7-tetrachlorophthalide
<Others>

3-(4-Diethylamino-2-ethoxyphenyl)-3-(1-ethyl-2-methylindol-3-yl)-4-azaphthalide.
3-(4-Diethylamino-2-ethoxyphenyl)-3-(1-octyl-2-methylindol-3-yl)-4-azaphthalide
3-(4-Cyclohexylethylamino-2-methoxyphenyl)-3-(1-ethyl-2-methylindol-3-yl)-4-azaphthalide
3,3-Bis(diethylamino)fluorane-7-(4'-nitro)anilinolactam
1,1-Bis-[2',2',2",2"-tetrakis-(p-dimethylaminophenyl)-ethenyl]-2,2-dinitrileethane
1,1-Bis-[2',2',2",2"-tetrakis-(p-dimethylaminophenyl)-ethenyl]-2,2-naphthoyleethane
1,1-Bis-[2',2',2",2"-tetrakis-(p-dimethylaminophenyl)-ethenyl]-2,2-diacetylethane
Bis-[2,2,2',2'-tetrakis-(p-dimethylaminophenyl)-ethenyl]-methylmalonic acid dimethyl ester.

These dye precursors may be used alone or as mixtures of two or more types.

In the present invention, a prior art color developer for color developing the dye precursor can be used in combination with the compound of Formula (1), (2), (3), (4) or (5) inasmuch as the desired effect is not deteriorated. Such a color developer includes a bisphenol A described in Japanese OPIs 3-207688, 5-24366, and the like, 4-hydroxybenzoic acid esters, 4-hydroxyphthalic acid diesters, phthalic acid monoesters, bis-(hydroxyphenyl) sulfides, 4-hydroxyphenylarylsulfones, 4-hydroxyphenylarylsulfonates, 1,3-di[2-(hydroxyphenyl)-2-propyl]-benzenes, 4-hydroxybenzoyloxybenzoic acid ester, and bisphenolsulfones.

The optical recording medium of the present invention, in order to achieve recording utilizing an action to convert light to heat, can use a prior art thermal recording sensitizer inasmuch as the desired effect for the object is not deteriorated. Such a sensitizer includes stearic acid amide, palmitic acid amide, ethylene-bisamide, montan wax, polyethylene wax, 1,2-di-(3-methylphenoxy)ethane, p-benzylbiphenyl, β-benzyloxynaphthalene, 4-biphenyl-p-tolylether, m-terphenyl, 1,2-diphenoxyethane, dibenzyl oxalate, di(p-chlorobenzyl) oxalate, di(p-methylbenzyl) oxalate, dibenzyl terephthalate, benzyl p-benzyloxybenzoate, di-p-tolylcarbonate, phenyl-α-naphthylcarbonate, 1,4-diethoxynaphthalene, 1-hydroxy-2-naphthoic acid phenyl ester, o-xylylene-bis-(phenylether), and 4-(m-methylphenoxymethyl)biphenyl. However, the sensitizer is not specifically limited to these substances. These sensitizers may be used alone or as mixtures of two or more types.

The light absorber used in the optical recording medium of the present invention may be simply mixed in the materials required for the optical recording medium but, alternatively, as described in Japanese OPI 2-217287, can be previously melted or dispersed in the materials of the inventive optical recording medium. Such materials in which the light absorber is previously melted or dispersed are, for example, the thermal recording sensitizer, the inventive color developer, a prior art color developer, a composition of the thermal recording sensitizer and the inventive color developer, a composition of the thermal recording sensitizer and the prior art color developer, and a composition of the thermal recording sensitizer and the dye precursor.

Further, the light absorber used in the optical recording medium of the present invention can also be used in such a way that the materials of the inventive optical recording medium and the light absorber are previously dissolved or dispersed in a solvent, the dissolved or dispersed mixture of the light absorber and the materials are separated from the solvent, and then used. The materials with which the light absorber is dissolved or dispersed in a solvent are similar to those materials shown above in which the light absorber is previously melted or dispersed.

Further, the light absorber used in the inventive optical recording medium may be co-dispersed (simultaneously dispersed) with one of the dye precursor, color developer or the sensitizer. Further, the light absorber may co-dispersed (simultaneously dispersed) with a combination of the dye precursor with the sensitizer, or the color developer with the sensitizer.

The light absorber used in the inventive optical recording medium, or the light absorber melted, solvent-dissolved, or dispersed with the above materials, may be mixed with the thermal color developing material comprising the color developer and the dye precursor, and used as a component of the materials of the light absorber thermal recording layer. Further, the light absorber may be used as an ingredient of the light absorber layer on and under the thermal recording layer comprising the inventive color developer and dye precursor. Further, the light absorber may be internally added or impregnated into the substrate to be used as a component of a light absorber substrate. The thermal recording layer or the light absorber thermal recording layer may be formed on the light absorber substrate. The thermal recording layer or the light absorber thermal recording layer on the light absorber substrate may have a multi layered structure.

The binder used in the present invention includes completely-hydrolyzed polyvinylalcohol having a polymerization degree of 200 to 1900, partially-hydrolyzed polyvinylalcohol, carboxy-modified polyvinylalcohol, amide-modified polyvinylalcohol, sulfonic acid-modified polyvinylalcohol, butyral-modified polyvinylalcohol, other modified polyvinylalcohols, hydroxyethylcellulose, methylcellulose, carboxymethylcellulose, styrene-maleic anhydride copolymer, styrene-butadiene copolymer, cellulose derivatives such as ethylcellulose and acetylcellulose, polyvinylchloride, polyvinylacetate, polyacrylamide, polyacrylic acid esters, polyvinylbutyral, polystyrene and copolymers thereof, polyamide resins, silicone resins, petroleum resins, terpene resins, ketone resins, and coumarone resins. These polymeric substances are used by dissolving in solvents such as water, alcohol, ketone, ester, and hydrocarbon, emulsifying in water or other solvents, or dispersing to a paste form, and can be used in combination according to the quality requirements.

A filler used in the present invention includes inorganic or organic fillers such as silica, calcium carbonate, kaolin, calcined kaolin, diatomaceous earth, talc, titanium oxide, aluminum hydroxide, polystyrene resin, urea-formaldehyde resin, styrene-methacrylic acid copolymer, styrene-butadiene copolymer, and hollow plastic pigments.

In addition to the above, a release agent such as fatty acid metal salts, a slip agent such as waxes, benzophenone or benzotriazole type ultraviolet absorbers, a water-resistant agent such as glyoxal, a dispersant, a defoamer, an antioxidant, and a fluorescent dye can be used.

Types and amounts of the color developer, dye precursor, and other ingredients used in the inventive optical recording medium are determined by the required properties and recording adaptability, and are not specifically limited but, normally, based on one part of the dye precursor, 1 to 8 parts of the organic color developer, and 1 to 20 parts of the filler are used, and the binder is preferably used in an amount of 10 to 25% by weight to the total solid. The amount of the light absorber is determined according to the required light absorbing ability.

The substrate can be paper, synthetic paper, plastic films, non-woven fabrics, metal foils, and the like, and composite sheets thereof can also be used. The coating color comprising the above composition is coated on a desired substrate to obtain the objective optical recording medium.

Further, to enhance the preservability, an overcoating layer comprising a polymeric substance can be provided on top of the thermal recording layer. The light absorber may be added to the overcoating layer.

Further, to enhance the preservability and sensitivity, an undercoating layer containing an organic or inorganic filler can be provided between the color developing layer and the substrate. The light absorber may be added to the undercoating layer.

The light absorber, the color developer, the dye precursor, and the materials to be added as necessary are finely ground by a grinder such as a ball mill, an attritor, or a sand grinder, or an appropriate emulsifying device to a particle diameter of several microns or less, and then a binder and, as necessary, other additives are added to obtain a coating color.

The light source for achieving optical recording on the inventive optical recording medium can be various lasers such as a semiconductor laser, a diode pumping YAG laser, or the like, a xenon flash lamp, and a halogen lamp. Light emitted from these light sources may be converged by light conversion means such as lenses to irradiate the optical recording medium of the present invention. The light may also be scanned by a mirror to achieve optical scanning recording.

Since the inventive optical recording medium using the compound of Formula (4) or (5) as the color developer is extremely high in heat resistance and heat stability of background, it can be heat laminated with a plastic film to provide a strong protective film. Therefore, before or after recording by light, using a commercial laminator, it can be easily heat laminated with a plastic film to obtain a card protected with a plastic film with improved heat resistance and stability. In particular, the inventive optical recording medium can be additionally recorded through the laminated plastic film. The base material of the heat lamination plastic film includes polyethylene terephthalate (PET), polypropylene (PP), and the like, and the heat sealing agent for the heat lamination plastic film can be thermoplastic resins such as low-density polyethylene, ethylene/vinyl acetate copolymer (EVA), ethylene/ethyl acrylate copolymer (EEA), ethylene/methyl methacrylate copolymer (EMAA), and ethylene/methacrylic acid copolymer (EMAA).

In addition, the optical recording medium of the present invention can be extrusion coated with an extrusion coating resin. The extrusion coating resin includes the thermoplastic resins usable for the above heat sealing agent, polypropylene (PP) and polyethylene terephthalate (PET).

The reason why the optical recording medium of the present invention comprising a color developer of Formula (1), (2), (3), (4) or (5) and a light absorber enables optical recording, the color developed recording image shows good stability to oil and a plasticizer, and is superior in heat resistance has yet to be elucidated, but can be considered as follows:

The compound of Formula (1), (2), (3), (4) or (5) is able to undergo a structural change as shown below according to the condition.

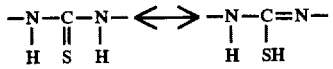

(Thione form) (Thiol form)

For the compound to function as a color developer of the optical recording medium, a high temperature is required to effect a tautomerism from the neutral type thione form to the acid type thiol form.

Since the light absorber exists in the inventive optical recording medium, light emitted from the recording light source is at the same time efficiently absorbed by the light absorber and efficiently converted to heat. At this moment, a high temperature of above 200° C. is momentarily generated. Then, the compound of compound of Formula (1), (2), (3), (4) or (5) contained in the optical recording medium undergoes the tautomerisation to the acid type thiol form, which has a color developing function to the dye precursor. This breaks the lactone ring of the dye precursor to develop a color.

The reason for the stability of the optical recording image to oil and plasticizer is considered as due to the fact that the acid-form aryl thiourea group is stronger in bonding force to the dye precursor than phenolic hydroxyl group and that two or more thiourea groups are present. Further, that the compound of Formula (1), (2), (3), (4) or (5) of the present invention having two or more thiourea groups is low in solubility to oil or plasticizer is considered to contribute the improved stability of the recorded image.

Further, the compound of Formula (1), (2), (3), (4) or (5) is also considered to be low in solubility in water, which is considered to suppress coloring of coating color, and to suppress fogging over time due to humidity and contribute to the improved stability of background.

The improved heat resistance of background is considered as due to the temperature at which the tautomerism from the neutral type thione structure to the acid type thiol structure takes place. Since the structural change to the acid type thiol structure which exhibits the color developing action requires a high temperature (above about 200° C.), the neutral type thione structure which cannot develop the dye precursor is unchanged until that temperature is applied, and the background is not developed. Therefore, even an optical recording medium comprising a dye precursor can be recorded by optical recording by light absorption and conversion to heat which can momentarily supply a high temperature, but background developing does not occur at temperatures below 100° C.

In the optical recording medium of the present invention containing a sensitizer, even though the sensitizer is dissolved, the background is not developed since it does not exhibit the color developing function as far as the compound of Formula (1), (2), (3), (4) or (5) changes to the acid type thiol structure due to the tautomerism. On the other hand, since the high temperature condition given by the light absorption and conversion to heat causes the sensitizer to dissolve and induce the transformation to the acid type thiol structure, the dye precursor and the compound of Formula (1), (2), (3), (4) or (5) are mixed better by the function of the sensitizer, and the recording sensitivity is improved. Therefore, even the optical recording medium containing the sensitizer, which can be recorded by optical recording by the light absorption and conversion to heat by a momentarily supplied high temperature, but the background is not developed at temperatures of about 100° C.

Since the temperature for the compound of Formula (4) or (5) to change to the acid type thiol structure is higher than the temperature required for heat lamination, the background will never be developed even in a high-temperature environment such as heat lamination.

Further, in the optical recording medium of the above construction which is heat laminated, since light emitted from the recording light source transmits the plastic film present on the optical recording layer, reaches the light absorber in the optical recording layer, and converted to heat, optical recording is possible even after heat lamination.

DETAILED DESCRIPTION OF PREFERRED EMBODIMENTS

The present invention will now be described with reference to the Examples. In the following description, unless otherwise noted, part and % indicate part by weight and % by weight, respectively.

<Production of optical recording medium>

<Examples 1–57, Comparative Examples 1–33>

EXAMPLES 1–16

(Table 1)

Examples 1 to 16 use compounds (A-1), (A-8), (A-11), (A-13), (A-16), (A-17), (A-28) to (A-31), (A-34), (A-37), (B-2), (B-4), (C-1), or (C-8) as color developers, NK-2612 (Nippon Kanko Shikiso Kenkyusho) as a light absorber, and 3-N-n-diethylamino-6-methyl-7-anilinofluorane (ODB) as a dye precursor in the inventive optical recording medium.

A color developer dispersion (Liquid A), and a dye precursor dispersion (Liquid C) of the following compositions were separately wet milled by a sand grinder to an average particle diameter of 1 micron. The light absorber NK-2612 was dissolved in water as shown below:

| | |
|---|---|
| Liquid A (color developer dispersion) | |
| Color developer | 6.0 parts |
| 10% Aqueous polyvinylalcohol solution | 18.8 |
| Water | 11.2 |
| Liquid B (aqueous light absorber (1) solution) | |
| NK-2612 (light absorber (1)) | 0.04 part |
| Water | 3.96 |
| Liquid C (dye precursor dispersion) | |
| 3-N-n-diethylamino-6-methyl-7-anilinofluorane (ODB) | 2.0 parts |
| 10% Aqueous polyvinylalcohol solution | 4.6 |
| Water | 2.6 |

Then, the dispersions and solution were mixed in the following ratio to obtain a coating color.

| | |
|---|---|
| Liquid A (color developer dispersion) | 36.0 parts |
| Liquid B (light absorber (1) solution) | 4.0 |
| Liquid C (dye precursor dispersion) | 9.2 |
| Kaolin clay (50% dispersion) | 12.0 |

The coating color was coated on one side of a 50 g/m$^2$ base paper, and dried to obtain an optical recording medium with a coating weight of 6.0 g/m$^2$.

EXAMPLES 17–32

(Table 2)

In Example 17–32, the compounds used in Examples 1–16 as color developers, bis(1-tert-butyl-3,4-dithiophenolate)nickel-tetra-n-butylammonium (light absorber (2)) as a light absorbent, and 3-N-n-diethylamino-6-methyl-7-anilinofluorane (ODB) as a dye precursor were used in the optical recording media of the present invention. The bis(1-tert-butyl-3,4-dithiophenolate)nickel-tetra-n-butylammonium as the light absorber (light absorber (2)) was simultaneously dispersed with the color developers of Examples 1–16.

The simultaneous dispersion (Liquid D) of the color developer and the light absorber (2) of the following composition and the dye precursor dispersion (Liquid C) were separately wet milled by a sand grinder to an average particle diameter of 1 micron.

Liquid D (color developer, light absorber (2) simultaneous dispersion)

| | |
|---|---|
| Color developer | 6.0 parts |
| Bis(1-tert-butyl-3,4-dithiophenolate)nickel-tetra-n-butylammonium (light absorber (2) | 0.3 |
| 10% Aqueous polyvinylalcohol solution | 18.8 |
| Water | 11.2 |

The above dispersions were mixed in the following ratio to obtain a coating color.

| | |
|---|---|
| Liquid D (color developer/light absorber (2) simultaneous dispersion) | 36.3 parts |
| Liquid C (dye precursor dispersion) | 9.2 |
| Kaolin clay (50% dispersion) | 12.0 |

The coating color was coated on one side of a 50 g/m$^2$ base paper and dried to obtain an optical recording medium with a coating weight of 6.0 g/m$^2$.

EXAMPLES 33–38

(Table 4)

Examples 33–38 use compounds of (A-28) to (A-30) among those used as color developers in the optical recording media of Examples 1–16, bis(1-tert-butyl-3,4-dithiophenolate)nickel-tetra-n-butylammonium (light absorbent (2)) as a light absorber, and the following compounds other than ODB as dye precursors.

(Dye precursor)

ODB-2: 3-dibutylamino-6-methyl-7-anilinofluorane

PSD-150: 3-(N-cyclohexyl-N-methylamino)-6-methyl-7-anilinofluorane

Green 40: 3-diethylamino-7-(o-chloroanilino)fluorane

CVL: 3,3-bis(p-dimethylaminophenyl)-6-dimethylaminophthalide

The dye precursor dispersions other than ODB (Liquid E) were separately wet milled by a sand grinder to an average particle diameter of 1 micron.

Liquid E (dye precursor dispersion other than ODB)

| | |
|---|---|
| Dye precursor | 2.0 parts |
| 10% Aqueous polyvinylalcohol solution | 4.6 |
| Water | 2.6 |

As in Examples 17–32, the color developer and the light absorber were simultaneously dispersed (Liquid D). Then, the dispersions were mixed in the following ratio to obtain a coating color.

| | |
|---|---|
| Liquid D (color developer/light absorber (2) simultaneous dispersion) | 36.3 parts |
| Liquid E (dye precursor dispersion other than ODB) | 9.2 |
| Kaolin clay (50% dispersion) | 12.0 |

The coating color was coated on one side of a 50 g/m$^2$ base paper and dried to obtain an optical recording medium with a coating weight of 6.0 g/m$^2$.

EXAMPLES 39–41

(Table 4)

Examples 39–41 use equal-amount mixtures of two of the compounds (A-28), (A-30), (B-4), and (C-8) among those used as color developers in the optical recording media of Examples 17–32, bis(1-tert-butyl-3,4-dithiophenolate) nickel-tetra-n-butylammonium (light absorber (2)) as a light absorber, and ODB as a dye precursor (mixed color developer).

As in Examples 17–32, the color developer and the light absorber were simultaneously dispersed (Liquid D). When one of the color developer/light absorber simultaneous dispersions is referred to as Liquid D, the other color developer/light absorber dispersion is referred to as Liquid D'. The dye precursor dispersion (Liquid C) was treated as in Examples 1–16.

The dispersions were mixed in the following ratio to obtain a coating color.

| | |
|---|---|
| Liquid D (color developer/light absorber (2) simultaneous dispersion) | 18.2 parts |
| Liquid D' (color developer/light absorber (2) simultaneous dispersion) | 18.2 parts |
| Liquid C (dye precursor dispersion) | 9.2 |
| Kaolin clay (50% dispersion) | 12.0 |

The coating color was coated on one side of a 50 g/m$^2$ base paper and dried to obtain an optical recording medium with a coating weight of 6.0 g/m$^2$.

EXAMPLE 42 and 43

(Table 4)

Examples 42 and 43 use the compounds of (A-28) or (A-30) as color developers among those used in the optical recording media of Examples 17–32, bis(1-tert-butyl-3,4-dithiophenolate) nickel-tetra-n-butylammonium (light absorber (2)) as a light absorber, and equal-amount mixtures of two of ODB, ODB-2, and PSD-150 as dye precursors (mixed dye precursor).

As in Examples 17–32, the color developer and the light absorber were simultaneously dispersed (Liquid D). The dye precursor dispersion (Liquid C) was treated as in Examples 1–16, and the dye precursor dispersion other than ODB (Liquid E) was treated as in Examples 33–38.

Then, the dispersions were mixed in the following ratio to obtain a coating color.

| | |
|---|---|
| Liquid D (color developer/light absorber simultaneous dispersion) | 18.2 parts |
| Liquid C (dye precursor dispersion) or Liquid E (dye precursor dispersion other than ODB) | 4.6 |
| Liquid E (dye precursor dispersion) other than ODB) | 4.6 |
| Kaolin clay (50% dispersion) | 12.0 |

The coating color was coated on one side of a 50 g/m$^2$ base paper and dried to obtain an optical recording medium with a coating weight of 6.0 g/m$^2$.

EXAMPLES 44–50

(Table 6)

In Examples 44–50, optical recording media were prepared using the compounds of (A-28) to (A30), (B-2), (B-4), (C-1), and (C-8) as color developers selected from those used in Examples 1–16, a heat melt of bis(1-tert-butyl-3,4-dithiophenolate) nickel-tetra-n-butylammonium and a sensitizer (light absorber (3)) as a light absorber, and using the same procedure as in Examples 1–16.

The color developer dispersion (Liquid A) used in Examples 1–16, the dye precursor dispersion (Liquid C), and the light absorber (3) dispersion of the following composition (Liquid F) were separately wet milled by a sand grinder to an average particle diameter of 1 micron.

Liquid F (light absorber dispersion)

Twelve parts of bis(1-tert-butyl-3,4-dithiophenolate) nickel-tetra-n-butylammonium was added to 88 parts of 4-biphenyl-p-tolylether, heated to 100° to 150° C., melted and mixed, and crushed to obtain a light absorber (3).

| | |
|---|---|
| Light absorber (3) | 2.0 parts |
| 10% Aqueous polyvinylalcohol solution | 10.0 |
| Water | 6.0 |

The Liquid F and the color developer dispersion (Liquid A) of (A-28) to (A30), (B-2), (B-4), (C-1), or (C-8) selected from the compounds used in Examples 1–16, and the dye precursor dispersion (Liquid C) were mixed in the following ratio to obtain a coating color.

| | |
|---|---|
| Liquid A (color developer dispersion) | 36.0 parts |
| Liquid F (light absorber (3) dispersion) | 18.0 |
| Liquid C (dye precursor dispersion) | 9.2 |
| Kaolin clay (50% dispersion) | 12.0 |

The coating color was coated on one side of a 50 g/m$^2$ base paper and dried to obtain an optical recording medium with a coating weight of 6.0 g/m$^2$.

EXAMPLES 51–57

(Table 6)

In Examples 51–57, a light absorber color developing layer using the compounds (A-28) to (A-30), (B-2), (B-4), (C-1) or (C-8) as a color developer selected from those used in Examples 1–16, a heat melt of bis(1-tert-butyl-3,4-dithiophenolate) nickel-tetra-n-butylammonium and a sensitizer (light absorber (3))as a light absorbent, and 3-N-n-diethylamino-6-methyl-7-anilinofluorane (ODB) as a dye precursor was provided on a light absorber underlayer comprising a filler and graphite (light absorber (4)) on base paper.

Preparation of the coating color for the light absorber underlayer is shown below.

Liquid E (light absorber [for underlayer] dispersion)

| | |
|---|---|
| Artificial graphite | 5.0 parts |
| 10% Aqueous polyvinylalcohol solution | 12.5 |
| Water | 7.5 |

The light absorber dispersion (Liquid E) was wet milled by a sand grinder to an average particle diameter of 1 micron. The Liquid E was mixed in the following ratio to obtain a coating color.

| | |
|---|---|
| Liquid E (light absorber [for underlayer] dispersion) | 20.0 parts |
| Kaolin clay (50% dispersion) | 200.0 |
| 10% Aqueous polyvinylalcohol solution | 40.0 |

The coating color was coated on one side of a 50 g/m$^2$ base paper and dried to form a light absorber underlayer with a coating weight of 4.0 g/m$^2$, thus obtaining a light absorber undersheet.

A coating color for the light absorber color developing layer was prepared from the Liquids A, F, and C as in Examples 44–50, which was coated on the light absorber underlayer side on the light absorber undersheet, and dried to obtain an optical recording medium with a coating weight of 6.0 g/m$^2$.

Comparative Examples 1–7

(Table 4)

In Comparative Examples 1–7, the light absorber was eliminated from the optical recording media comprising the light absorber, the color developer, and the dye precursor.

Optical recording media were prepared by eliminating the light absorber from the compositions of the optical recording media of Examples 7–9 or 13–16.

Comparative Examples 8–15

(Table 3)

In Comparative Examples 8, 10, 12, or 14, optical recording media were prepared using the same procedure as in Examples 1–16 except that the color developer compounds used in 1–16 were substituted with the conventional color developers shown below.

BPA: Bisphenol A

BPS: Bisphenol S

POB: Benzyl p-hydroxybenzoate

D-8: 4-Hydroxy-4'-isopropoxydiphenylsulfone

Liquid G (prior art color developer dispersion)

| | |
|---|---|
| Prior art color developer | 6.0 parts |
| 10% Aqueous polyvinylalcohol solution | 18.8 |
| Water | 11.2 |

The Liquid G was used in place of the Liquid A shown in Examples 1–16 to obtain a coating color.

The coating color was coated on one side of a 50 g/m$^2$ base paper and dried to obtain an optical recording medium with a coating weight of 6.0 g/m$^2$ (Comparative Examples 8, 10, 12, 14).

In Comparative Examples 9, 11, 13, and 15, optical recording media were prepared using the same procedure as in Examples 17–32 except that the color developers used in Examples 17–32 were substituted with the above prior art color developers.

Liquid H (prior art color developer/light absorber simultaneous dispersion)

| | |
|---|---|
| Prior art color developer | 6.0 parts |
| Bis(1-tert-butyl-3,4-dithiophenolate) nickel-tetra-n-butylammonium (light absorber (2)) | 0.3 |
| 10% Aqueous polyvinylalcohol solution | 18.8 |
| Water | 11.2 |

The Liquid H was used in place of the Liquid D shown in Examples 17–32 to obtain a coating color. The coating color was coated on one side of a 50 g/m$^2$ base paper and dried to obtain an optical recording medium with a coating weight of 6.0 g/m$^2$ (Comparative Examples 9, 11, 13, 15).

Comparative Examples 16–19

(Table 5)

Comparative Examples 16–19 use prior art color developers and dye precursors other than ODB in Comparative Examples 9, 11, 13, and 15 (light absorbent (2) used) (comparative examples to Examples 33–38).

In Comparative Examples 9, 11, 13, or 15, optical recording media were prepared using the same procedure as in Comparative Examples 9, 11, 13, or 15 except that the Liquid E was used in place of the Liquid C.

Comparative Examples 20–23

(Table 7)

In Comparative Examples 20–23, optical recording media were prepared using the same procedure as in Examples 44–50 except that the color developers used in Examples 44–50 (light absorber (3) used) were substituted with the above prior art color developers.

<Evaluation of optical recording media: Examples 1–57, Comparative Examples 1–23>

[Optical recording test A]

Laser recording was made on the optical recording media of Examples 1–57 and Comparative Examples 1–23 by the following method using a laser plotter apparatus described in Japanese OPI 3-239598. A 30mW semiconductor laser LT015MD (made by Sharp Co., Ltd.) of 830 nm in oscillation wavelength was used as an optical recording light source, and two aspheric plastic lenses AP4545 (made by Konica Co., Ltd.) with a numerical aperture of 0.45 and a focal length of 4.5 mm were used as converging lenses. A laser recording head comprising the semiconductor laser and the lenses was scanned at a recording speed of 50 mm/sec and a recording line interval of 50 microns to obtain a 1 cm square overall color developed image. The 1 cm square overall color developed image was measured for density by a Macbeth densitometer (RD-914, an amber filter used). The measured values are shown in Tables 1 to 7 in the column of [Optical recording density].

Sufficient recording densities were obtained with the inventive optical recording media shown in Examples 1–57 by the above laser recording.

On the other hand, the optical recording media with no light absorber shown in Comparative Examples 1–7 could not be recorded by the above laser recording.

[Optical recording test B]

Optical recording was made on the optical recording media of Examples 1–57 and Comparative Examples 1–23 using stroboscopic flash light. In optical recording, a light emitting window of a camera stroboscopic flash lamp auto4330 (made by SUNPACK Co., Ltd.) was narrowed to 5%, which was used for irradiating the optical recording media. The color developed image was measured for density by the Macbeth densitometer (RD-914, an amber filter used). The measured values are shown in Tables 1 to 7 in the column of [Optical recording density B].

Sufficient recording densities were obtained with the optical recording media using the inventive compounds shown in Examples 1–57 by the above stroboscopic flash light recording.

On the other hand, the optical recording media with no light absorber shown in Comparative Examples 1–7 could not be recorded with the above stroboscopic flash light.

[Untreated background density]

The optical recording media of Examples 1–57 and Comparative Examples 1–23 before optical recording (untreated condition) were measure for density by the Macbeth densitometer (RD-914, an amber filter used).

[Plasticizer resistance test]

The plasticizer resistance test was conducted as follows: A plasticizer-containing PVC wrap HIWRAP KMX-S (made by Mitsui Toatsu Chemicals Co., Ltd. ) was contacted closely with the optical recording image (1 cm square overall color developed image) and allowed to stand for 1 hour at room temperature. Then, the PVC wrap was peeled from the optical recording image, and the PVC wrap treated 1 cm square overall color developed image was measured for density by the Macbeth densitometer (RD-914, an amber filter used). The measured values are shown in Tables 1 to 7 in the column of [Retention %]. Retention % in Tables 1 to 7 was calculated by the following equation.

$$\text{Retention \%} = \frac{\text{optical recording density after treatment}}{\text{untreated optical recording density}} \times 100.$$

The inventive optical recording media (Examples 1–57), compared especially to BPA, POB, or D-8 used as conventional color developers, exhibited very high stability to plasticizer.

[Background stability test]

To determine the thermal stability of background of the optical recording medium, the medium was pressed against a hot plate heated to 105° C. for 5 seconds at a pressure of 8 g/cm$^2$, and the heated portion was measure for density by the Macbeth densitometer (RD-914, an amber filter used). The measured values are shown in Tables 1 to 7 in the column of [Background density].

The smaller the value, the smaller the developing of background and the higher the thermal stability. The inventive optical recording media in Examples 1–57 had no background density exceeding 0.2, showing very high heat resistance.

[Coloring of coating color]

Coating colors of Examples 1–57 and Comparative Examples 1–23 were visually checked for coloring at the preparation, and evaluated as follows:

A: No coloring of coating color

B: Nearly no coloring

C: Slight coloring

D: Coloring noted.

Coloring of the coating color will impair the background density, and tends to result in ground color fogging with passage of time (effect of moisture, or the like).

No coloring of the coating color was noted in the inventive optical recording media of Examples 1–57. On the other hand, coloring of coating color was noted in Comparative Examples 10, 11, 17, and 21 using BPS as the color developer.

[Fogging over time]

The optical recording media of Examples 1–57 and Comparative Examples 1–23 were measured for background density over time 1 month after the preparation by the Macbeth densitometer (RD-914, an amber filter used).

No change in background density was noted in the optical recording media of Examples 1–57. On the other hand, background fogging was noted in Comparative Examples 10, 11, 17, and 21 using BPS as the color developer.

TABLE 1

| Example | Color developer | Light absorber | Optical recording density A | Optical recording density B | Untreated density | Retention % | Background density | Coloring | Fogging over time |
|---|---|---|---|---|---|---|---|---|---|
| Example 1 | A-1 | (1) | 0.79 | 0.94 | 0.11 | 97 | 0.17 | A | 0.11 |
| Example 2 | A-8 | (1) | 0.88 | 0.99 | 0.11 | 98 | 0.17 | A | 0.11 |
| Example 3 | A-11 | (1) | 0.94 | 1.08 | 0.11 | 96 | 0.18 | A | 0.11 |
| Example 4 | A-13 | (1) | 0.88 | 1.03 | 0.11 | 97 | 0.18 | A | 0.11 |
| Example 5 | A-16 | (1) | 1.13 | 1.21 | 0.12 | 96 | 0.16 | A | 0.12 |
| Example 6 | A-17 | (1) | 1.12 | 1.25 | 0.12 | 96 | 0.15 | A | 0.12 |
| Example 7 | A-28 | (1) | 1.18 | 1.32 | 0.11 | 100 | 0.12 | A | 0.11 |
| Example 8 | A-29 | (1) | 1.16 | 1.30 | 0.13 | 98 | 0.13 | A | 0.13 |
| Example 9 | A-30 | (1) | 1.17 | 1.31 | 0.12 | 97 | 0.12 | A | 0.12 |
| Example 10 | A-31 | (1) | 0.80 | 0.95 | 0.11 | 96 | 0.14 | A | 0.11 |
| Example 11 | A-34 | (1) | 0.94 | 1.10 | 0.11 | 100 | 0.14 | A | 0.11 |
| Example 12 | A-37 | (1) | 0.90 | 1.04 | 0.11 | 99 | 0.17 | A | 0.11 |
| Example 13 | B-2 | (1) | 1.17 | 1.32 | 0.13 | 100 | 0.13 | A | 0.13 |
| Example 14 | B-4 | (1) | 1.17 | 1.32 | 0.12 | 100 | 0.13 | A | 0.12 |
| Example 15 | C-1 | (1) | 1.15 | 1.31 | 0.13 | 98 | 0.13 | A | 0.13 |
| Example 16 | C-8 | (1) | 1.16 | 1.32 | 0.12 | 98 | 0.13 | A | 0.12 |

ODB used as dye precursor.

TABLE 2

| Example | Color developer | Light absorber | Optical recording density A | Optical recording density B | Untreated density | Retention % | Background density | Coloring | Fogging over time |
|---|---|---|---|---|---|---|---|---|---|
| Example 17 | A-1 | (2) | 0.75 | 0.91 | 0.07 | 96 | 0.13 | A | 0.07 |
| Example 18 | A-8 | (2) | 0.85 | 1.00 | 0.07 | 98 | 0.13 | A | 0.07 |
| Example 19 | A-11 | (2) | 0.90 | 1.03 | 0.07 | 95 | 0.14 | A | 0.07 |
| Example 20 | A-13 | (2) | 0.85 | 0.99 | 0.07 | 96 | 0.14 | A | 0.07 |
| Example 21 | A-16 | (2) | 1.09 | 1.24 | 0.08 | 95 | 0.12 | A | 0.08 |
| Example 22 | A-17 | (2) | 1.08 | 1.22 | 0.08 | 95 | 0.11 | A | 0.08 |
| Example 23 | A-28 | (2) | 1.15 | 1.32 | 0.07 | 100 | 0.09 | A | 0.07 |
| Example 24 | A-29 | (2) | 1.11 | 1.29 | 0.09 | 98 | 0.09 | A | 0.09 |
| Example 25 | A-30 | (2) | 1.13 | 1.30 | 0.07 | 96 | 0.08 | A | 0.07 |
| Example 26 | A-31 | (2) | 0.77 | 0.92 | 0.07 | 95 | 0.10 | A | 0.07 |
| Example 27 | A-34 | (2) | 0.90 | 1.04 | 0.07 | 100 | 0.10 | A | 0.07 |
| Example 28 | A-37 | (2) | 0.85 | 0.99 | 0.07 | 98 | 0.13 | A | 0.07 |
| Example 29 | B-2 | (2) | 1.12 | 1.30 | 0.09 | 100 | 0.09 | A | 0.09 |
| Example 30 | B-4 | (2) | 1.13 | 1.31 | 0.08 | 100 | 0.09 | A | 0.08 |
| Example 31 | C-1 | (2) | 1.11 | 1.30 | 0.09 | 97 | 0.09 | A | 0.09 |
| Example 32 | C-8 | (2) | 1.12 | 1.30 | 0.08 | 98 | 0.09 | A | 0.08 |

ODB used as dye precursor.

TABLE 3

| Example | Color developer | Light absorber | Optical recording density A | Optical recording density B | Untreated density | Retention % | Background density | Coloring | Fogging over time |
|---|---|---|---|---|---|---|---|---|---|
| Comp. Ex. 1 | A-28 | None | — | — | 0.03 | — | 0.05 | A | 0.03 |
| Comp. Ex. 2 | A-29 | None | — | — | 0.05 | — | 0.05 | A | 0.05 |
| Comp. Ex. 3 | A-30 | None | — | — | 0.04 | — | 0.04 | A | 0.04 |
| Comp. Ex. 4 | B-2 | None | — | — | 0.05 | — | 0.05 | A | 0.05 |
| Comp. Ex. 5 | B-4 | None | — | — | 0.04 | — | 0.05 | A | 0.04 |
| Comp. Ex. 6 | C-1 | None | — | — | 0.06 | — | 0.06 | A | 0.06 |
| Comp. Ex. 7 | C-8 | None | — | — | 0.05 | — | 0.05 | A | 0.05 |
| Comp. Ex. 8 | BPA | (1) | 1.27 | 1.31 | 0.15 | 15 | 0.70 | B | 0.19 |
| Comp. Ex. 9 | BPA | (2) | 1.25 | 1.30 | 0.10 | 14 | 0.62 | B | 0.13 |
| Comp. Ex. 10 | BPS | (1) | 0.99 | 1.13 | 0.17 | 63 | 0.25 | D | 0.30 |
| Comp. Ex. 11 | BPS | (2) | 0.97 | 1.11 | 0.12 | 61 | 0.20 | D | 0.23 |
| Comp. Ex. 12 | POB | (1) | 1.31 | 1.35 | 0.13 | 9 | 1.35 | A | 0.13 |
| Comp. Ex. 13 | POB | (2) | 1.28 | 1.35 | 0.09 | 8 | 1.35 | A | 0.09 |
| Comp. Ex. 14 | D-8 | (1) | 1.24 | 1.34 | 0.13 | 23 | 1.35 | A | 0.14 |
| Comp. Ex. 15 | D-8 | (2) | 1.23 | 1.35 | 0.09 | 20 | 1.32 | A | 0.10 |

ODB used as dye precursor.

TABLE 4

| Example | Color developer | Dye precursor | Optical recording density A | Untreated density | Retention % | Background density | Coloring | Fogging over time |
|---|---|---|---|---|---|---|---|---|
| Example 33 | A-28 | ODB-2 | 1.16 | 0.07 | 99 | 0.08 | A | 0.07 |
| Example 34 | A-28 | PSD-150 | 1.14 | 0.07 | 100 | 0.08 | A | 0.07 |
| Example 35 | A-29 | Green40 | 1.02 | 0.08 | 97 | 0.08 | A | 0.08 |
| Example 36 | A-29 | CVL | 1.08 | 0.08 | 97 | 0.08 | A | 0.08 |
| Example 37 | A-30 | ODB-2 | 1.14 | 0.07 | 98 | 0.08 | A | 0.07 |
| Example 38 | A-30 | CVL | 1.10 | 0.07 | 97 | 0.07 | A | 0.07 |
| Example 39 | A-28/A-30 | ODB | 1.15 | 0.07 | 100 | 0.09 | A | 0.07 |
| Example 40 | A-28/B-4 | ODB | 1.14 | 0.07 | 100 | 0.09 | A | 0.07 |
| Example 41 | A-28/C-8 | ODB | 1.13 | 0.07 | 98 | 0.09 | A | 0.07 |
| Example 42 | A-28 | ODB/ODB-2 | 1.16 | 0.07 | 100 | 0.09 | A | 0.07 |
| Example 43 | A-28 | ODB-2/PSD150 | 1.13 | 0.07 | 99 | 0.09 | A | 0.07 |

TABLE 5

| Example | Color developer | Dye precursor | Optical recording density A | Untreated density | Retention % | Back-ground density | Coloring | Fogging over time |
|---|---|---|---|---|---|---|---|---|
| Comp. Ex. 16 | BPA | ODB-2 | 1.26 | 0.09 | 11 | 0.60 | B | 0.13 |
| Comp. Ex. 17 | BPS | PSD-150 | 0.95 | 0.11 | 61 | 0.20 | D | 0.22 |
| Comp. Ex. 18 | POB | Green40 | 1.10 | 0.09 | 9 | 1.05 | A | 0.09 |
| Comp. Ex. 19 | CVL | CVL | 1.01 | 0.09 | 12 | 0.93 | A | 0.09 |

TABLE 6

| Example | Color developer | Light absor-ber | Optical record-ing density A | Optical record-ing density B | Untreated density | Retention % | Back-ground density | Coloring | Fogging over time |
|---|---|---|---|---|---|---|---|---|---|
| Example 44 | A-28 | (3) | 1.18 | 1.35 | 0.07 | 100 | 0.10 | A | 0.07 |
| Example 45 | A-29 | (3) | 1.16 | 1.32 | 0.08 | 95 | 0.10 | A | 0.08 |
| Example 46 | A-30 | (3) | 1.17 | 1.34 | 0.07 | 95 | 0.09 | A | 0.07 |
| Example 47 | B-2 | (3) | 1.15 | 1.33 | 0.08 | 100 | 0.10 | A | 0.08 |
| Example 48 | B-4 | (3) | 1.17 | 1.33 | 0.08 | 100 | 0.10 | A | 0.08 |
| Example 49 | C-1 | (3) | 1.15 | 1.33 | 0.08 | 96 | 0.10 | A | 0.08 |
| Example 50 | C-8 | (3) | 1.15 | 1.33 | 0.08 | 97 | 0.10 | A | 0.08 |
| Example 51 | A-28 | (3), (4) | 1.27 | 1.44 | 0.16 | 100 | 0.19 | A | 0.16 |
| Example 52 | A-28 | (3), (4) | 1.25 | 1.39 | 0.17 | 95 | 0.19 | A | 0.17 |
| Example 53 | A-28 | (3), (4) | 1.26 | 1.43 | 0.16 | 96 | 0.19 | A | 0.16 |
| Example 54 | A-28 | (3), (4) | 1.23 | 1.42 | 0.17 | 100 | 0.19 | A | 0.17 |
| Example 55 | A-28 | (3), (4) | 1.25 | 1.42 | 0.17 | 100 | 0.19 | A | 0.17 |
| Example 56 | A-28 | (3), (4) | 1.24 | 1.42 | 0.17 | 98 | 0.19 | A | 0.17 |
| Example 57 | A-28 | (3), (4) | 1.24 | 1.42 | 0.17 | 97 | 0.19 | A | 0.17 |

ODB used as dye precursor.

TABLE 7

| Example | Color developer | Light absor-ber | Optical record-ing density A | Optical record-ing density B | Untreated density | Retention % | Back-ground density | Coloring | Fogging over time |
|---|---|---|---|---|---|---|---|---|---|
| Comp. Ex. 20 | BPA | (3) | 1.28 | 1.34 | 0.10 | 13 | 1.03 | B | 0.14 |
| Comp. Ex. 21 | BPS | (3) | 1.02 | 1.18 | 0.12 | 57 | 0.57 | D | 0.22 |
| Comp. Ex. 22 | POB | (3) | 1.30 | 1.34 | 0.08 | 8 | 1.35 | A | 0.08 |
| Comp. Ex. 23 | D-8 | (3) | 1.26 | 1.32 | 0.08 | 18 | 1.34 | A | 0.09 |

ODB used as dye precursor.

<Heat lamination test: Examples 58–71, Comparative Examples 24–31>

Then, as one of heat treatment tests, the inventive optical recording media were subjected to heat lamination test.

[Heat lamination test]

A simple lamination apparatus (MS POUCH H-140, Meiko Shokai) and a lamination film (MS POUCH FILM MP10-6095) were used. The optical recording media of Examples 7, 9, 23, 25, 44 to 53, and Comparative Examples 9, 11, 14, and 20 to 23, which were already subjected to optical recording (optical recording test A) under the above-described condition, were placed between the above lamination films, and fed at a feed speed of 20 mm/sec to obtain heat-laminated optical recording media having optical recording portions (Examples 58–71, Comparative Examples 24–31). After heat lamination, the color developed portions by optical recording and the background were measured through the lamination film of the laminated optical recording media for density by the Macbeth densitometer (greater values were given because measurement was made through the film). For the background, the smaller the Macbeth density value, the more stable the background. Contrast between the color developed portions and the background of the laminated optical recording media was evaluated as follows:

A: No or almost, no color developing of the background (heat lamination possible)

B: Color developing of background noted

C: Considerable color developing of background.

The laminated optical recording media (using prior art color developers) with a contrast evaluation of C were difficult to read, and substantially impossible to be heat laminated (Comparative Examples 24, 26 to 31). On the other hand, Examples 58–71 gave good contrast evaluation (A), and were possible to be heat laminated.

TABLE 8

| Example | Example No. of sheet used (*1) | Heat lamination test: Macbeth density Optical recording density A | Heat lamination test: Back-ground | Heat lamination test: Contrast evaluation |
|---|---|---|---|---|
| Example 58 | (Example 7) | 1.61 | 0.18 | A |
| Example 59 | (Example 9) | 1.60 | 0.18 | A |
| Example 60 | (Example 23) | 1.55 | 0.14 | A |
| Example 61 | (Example 25) | 1.54 | 0.14 | A |
| Example 62 | (Example 44) | 1.62 | 0.14 | A |
| Example 63 | (Example 45) | 1.60 | 0.15 | A |
| Example 64 | (Example 46) | 1.62 | 0.14 | A |
| Example 65 | (Example 47) | 1.59 | 0.15 | A |
| Example 66 | (Example 48) | 1.62 | 0.15 | A |
| Example 67 | (Example 49) | 1.59 | 0.15 | A |
| Example 68 | (Example 50) | 1.60 | 0.15 | A |
| Example 69 | (Example 51) | 1.68 | 0.22 | A |
| Example 70 | (Example 52) | 1.66 | 0.23 | A |
| Example 71 | (Example 53) | 1.66 | 0.22 | A |

*1: Example Nos. are shown in Tables 1, 2, and 6.

TABLE 9

| Example | Comparative Example No. of sheet used (*2) | Heat lamination test: Macbeth density Optical recording density A | Heat lamination test: Back-ground | Heat lamination test: Contrast evaluation |
|---|---|---|---|---|
| Comp. Ex. 24 | (Comp. Ex. 9) | 1.99 | 1.99 | C |
| Comp. Ex. 25 | (Comp. Ex. 11) | 1.77 | 0.40 | B |
| Comp. Ex. 26 | (Comp. Ex. 12) | 1.98 | 1.98 | C |
| Comp. Ex. 27 | (Comp. Ex. 14) | 1.99 | 1.92 | C |
| Comp. Ex. 28 | (Comp. Ex. 20) | 1.99 | 1.99 | C |
| Comp. Ex. 29 | (Comp. Ex. 21) | 1.95 | 1.92 | C |
| Comp. Ex. 30 | (Comp. Ex. 22) | 1.97 | 1.96 | C |
| Comp. Ex. 31 | (Comp. Ex. 23) | 1.99 | 1.98 | C |

*2: Example Nos. are shown in Tables 3 and 7.

<Optical recording test: Examples 72–85>

[Optical recording test (Table 10)]

The laminated optical recording media shown in Examples 58–71 were subjected to "Optical recording test A" and "Optical recording test B" (Examples 72–85). The optical recorded or additionally optical recorded and color developed images were measured for density through the lamination film by the Macbeth densitometer (RD-914, an amber filter used). The measured values are shown in Table 10.

The laminated optical recording media shown in Examples 58–71 were all possible to be recorded by laser recording (optical recording test A) and stroboscopic flash light recording (optical recording test B) through the lamination film, with sufficient recording densities,

TABLE 10

| Example | Example No. of laminated sheet used (*3) | Additional optical recording: Optical recording test A | Additional optical recording: Optical recording test B |
|---|---|---|---|
| Example 72 | (Example 58) | 1.58 | 1.72 |
| Example 73 | (Example 59) | 1.58 | 1.73 |
| Example 74 | (Example 60) | 1.53 | 1.68 |
| Example 75 | (Example 61) | 1.52 | 1.67 |
| Example 76 | (Example 62) | 1.60 | 1.77 |
| Example 77 | (Example 63) | 1.59 | 1.75 |
| Example 78 | (Example 64) | 1.60 | 1.76 |

TABLE 10-continued

| Example | Example No. of laminated sheet used (*3) | Additional optical recording: Optical recording test A | Additional optical recording: Optical recording test B |
|---|---|---|---|
| Example 79 | (Example 65) | 1.55 | 1.71 |
| Example 80 | (Example 66) | 1.59 | 1.74 |
| Example 81 | (Example 67) | 1.57 | 1.73 |
| Example 82 | (Example 68) | 1.57 | 1.72 |
| Example 83 | (Example 69) | 1.67 | 1.81 |
| Example 84 | (Example 70) | 1.65 | 1.80 |
| Example 85 | (Example 71) | 1.64 | 1.80 |

*3: Example Nos. are shown in Table 8.

An optical recording medium with very high heat resistance of background can be obtained and optical recording is easily achieved by an economical optical recording method by using a compound having a plurality of thiourea groups as a color developer and combining with a light absorber. Further, the recorded image obtained by irradiation with light has a very strong stability to oil, plasticizer, and heat.

Further, effects of the present invention are summarized as follows:

(1) Using the color developer of the present invention, an optical recording medium can be produced which is high in storage stability, and has a very strong stability to oil and plasticizers.

(2) By the presence of the light absorber, the optical recording sensitivity is very high, and various economical types of light sources can be used.

(3) Since a light-heat conversion action is utilized, optical recording with improve energy efficiency is possible compared to a thermal head.

(4) High density recording is possible when laser light is used as a recording light source.

(5) The optical recording medium can be used under extreme conditions.

(6) The optical recording medium can be used under extreme conditions (e.g. above 100° C.) under which prior art recording media could be used.

(7) Since the optical recording medium can be heat laminated by a heat laminator, a highly durable optical recording card can be easily prepared.

(8) The laminated optical recording medium can be further recorded by additional optical recording.

What is claimed is:

1. A heat resistant optical recording medium comprising a substrate having thereon a recording layer containing a dye precursor, a color developer reactable with said dye precursor to develop a color, and a light absorber for converting light to heat, wherein said color developer is at least one compound of the formula (4):

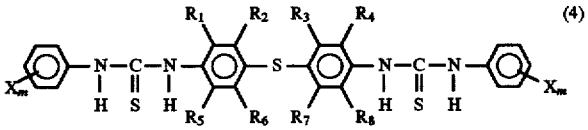

(4)

wherein X, $R_1$, $R_2$, $R_3$, $R_4$, $R_5$, $R_6$, $R_7$ and $R_8$ are lower alkyl having 1 to 6 carbon atoms, alkoxy having 1 to 6 carbon atoms, cyclohexyl, nitro, cyano, halogen or hydrogen; and m is an integer from 1 to 3.

2. The optical recording medium of claim 1, wherein the recording surface of the entire recording medium is laminated with a plastic film by the application of heat.

3. The optical recording medium of claim 2 wherein the optical recording medium has after lamination been recorded with stroboscopic flash light or laser light.

4. An optical recording medium which is heat resistant at temperatures of at least 105° C. comprising a substrate coated with a color developing layer, wherein the color developing layer comprises a dye precursor, a developer which reacts with the dye precursor to cause color development thereof upon heating, and a light absorber for converting light to heat, wherein the developer is at least one bisthiourea compound represented by the formula (4):

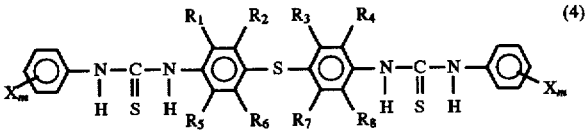

(4)

wherein X, $R_1$, $R_2$, $R_3$, $R_4$, $R_5$, $R_6$, $R_7$ and $R_8$ are lower alkyl having 1 to 6 carbon atoms, alkoxy having 1 to 6 carbon atoms, cyclohexyl, nitro, cyano, halogen or hydrogen; and m is an integer form 1 to 3.

5. The optical recording medium of claim 4 wherein the Macbeth background value after exposure to heat at a temperature of about 105° C. is 0.20 or less.

6. The optical recording medium of claim 4 or claim 5, wherein the recording surface of the entire recording medium is laminated with a plastic film by the application of heat.

7. A heat resistant optical recording medium comprising a substrate having thereon a recording layer containing a dye precursor, a color developer reactable with said dye precursor to develop a color, and a light absorber for converting light to heat, wherein said color developer is at least one compound of the Formula (4);

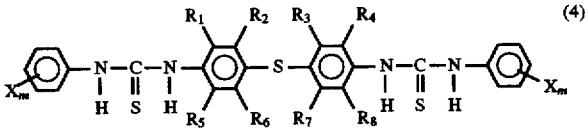

(4)

wherein X, $R_1$, $R_2$, $R_3$, $R_4$, $R_5$, $R_6$, $R_7$ and $R_8$ are lower alkyl having 1 to 6 carbon atoms, alkoxy having 1 to 6 carbon atoms, cyclohexyl, nitro, cyano, halogen or hydrogen; and m is an integer from 1 to 3, and wherein when a laser light is scanned over said optical recording medium, the optical recorded portion has a Macbeth optical density of greater than 0.7, and when said optical recording medium is pressed against a hot plate at 105° C. with a pressure of 8 g/cm$^2$ for 5 seconds, said optical recording medium other than the recorded portion has a Macbeth optical density of less than 0.2.

8. The optical recording medium of claim 7 wherein said laser light comprises a 30 mW laser light of 830 nm in oscillation wavelength focused by a lens with a focal length of 4.5 mm and a numerical aperture of 0.45 and is scanned over said optical recording medium at a recording speed of 50 mm/sec and at recording line interval of 50 μm.

9. The optical recording medium of claim 4 or 7 wherein X and $R_1$ to $R_8$ are methyl or chlorine.

10. The optical recording medium of claim 4 or 7 wherein the formula (4) compound is:

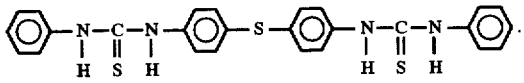

(A28)

11. The optical recording medium of claim 4 or 7 wherein the formula (4) compound is

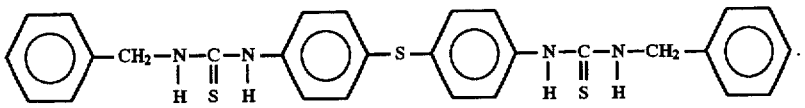

(A34)

12. The optical recording medium of claim 4 or 7 wherein the formula (4) compound is

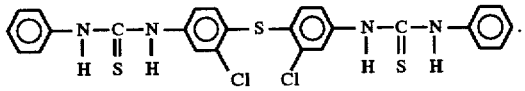

(B2)

13. The optical recording medium of claim 4 or 7 wherein the formula (4) compound is

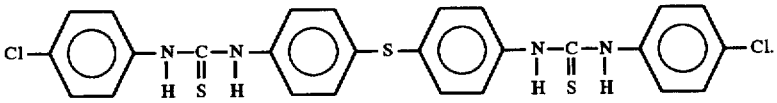

(B4)

* * * * *